US007219511B2

(12) United States Patent
Inaba et al.

(10) Patent No.: US 7,219,511 B2
(45) Date of Patent: May 22, 2007

(54) EVAPORATOR HAVING HEAT EXCHANGING PARTS JUXTAPOSED

(75) Inventors: Hiroyuki Inaba, Saitama (JP); Toru Kawamata, Tochigi (JP)

(73) Assignee: Calsonic Kansai Corporation, Tokyo (JP)

( * ) Notice: Subject to any disclaimer, the term of this patent is extended or adjusted under 35 U.S.C. 154(b) by 488 days.

(21) Appl. No.: 10/919,742

(22) Filed: Aug. 17, 2004

(65) Prior Publication Data

US 2005/0050915 A1 Mar. 10, 2005

(30) Foreign Application Priority Data

Sep. 9, 2003 (JP) ..... P2003-317253

(51) Int. Cl.
*F25B 39/02* (2006.01)

(52) U.S. Cl. ..... 62/515; 62/519; 165/153; 165/176

(58) Field of Classification Search ..... 62/515, 62/519; 165/153, 174, 176
See application file for complete search history.

(56) References Cited

U.S. PATENT DOCUMENTS 5,617,914 A * 4/1997 Kinugasa et al. ..... 165/153
6,032,729 A * 3/2000 Nishishita et al. ..... 165/153
6,173,764 B1 * 1/2001 Inoue ..... 165/153
6,397,938 B1 * 6/2002 Nishishita ..... 165/153

FOREIGN PATENT DOCUMENTS

| | | |
|---|---|---|
| JP | 06-74679 | 3/1994 |
| JP | 10-238896 | 9/1998 |
| JP | 2000-105091 | 4/2000 |

* cited by examiner

*Primary Examiner*—Melvin Jones
(74) *Attorney, Agent, or Firm*—Brenda O. Holmes; Kilpatrick Stockton LLP

(57) ABSTRACT

An evaporator includes a downwind-side heat exchanging part and an upwind-side heat exchanging part. In the heat exchanging part, paths are formed by partitions. In the evaporator, the flowing direction of coolant flowing in the upwind-side path is opposite to the flowing direction of the coolant flowing in the downwind-side path opposing to the upwind-side path. The number of heat exchanging passages in the path where the coolant rises is smaller than the number of heat exchanging passages in the paths where the coolant downs. As a result, the evaporator enables an increasing of the quantity of coolant flowing in the paths. Thus, if superimposing the upwind-side heat exchanging part on the downwind-side heat exchanging part, then it is possible to reduce an area causing a rise in blowout temperature of the coolant due to its short supply.

3 Claims, 15 Drawing Sheets

FIG.8C
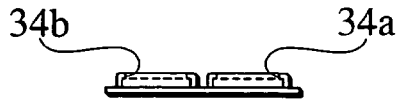
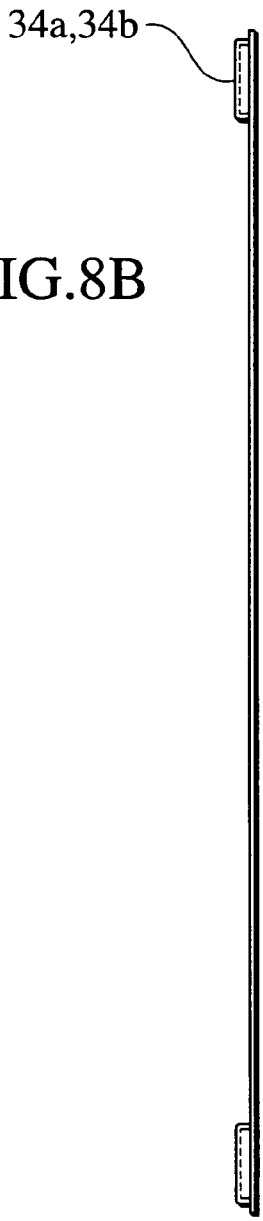
FIG.8B
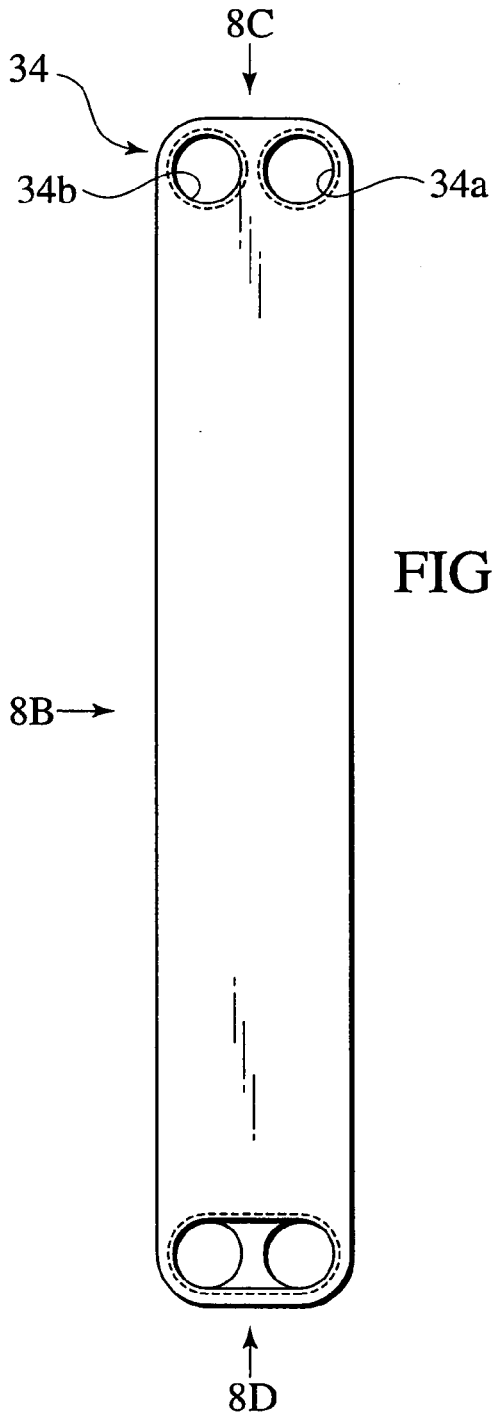
FIG.8A
FIG.8D
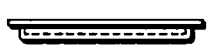

EVAPORATOR HAVING HEAT EXCHANGING PARTS JUXTAPOSED

BACKGROUND OF THE INVENTION

1. Field of the Invention

The present invention relates to an evaporator having two heat exchanging parts juxtaposed in the flowing direction of wind passing through the evaporator.

2. Description of the Related Art

An evaporator having two heat exchanging parts juxtaposed in the flowing direction of wind is disclosed in Japanese Patent Application Laid-open Nos. 6-74679, 10-238896 and 2000-105091.

The inventor is developing an evaporator shown in FIG. 1. The evaporator 100 includes two heat exchanging parts juxtaposed on upwind and downwind sides in the flowing direction of wind, respectively.

The "downwind-side" heat exchanging part 110 has an upper tank 111, a lower tank 112 and a plurality of heat exchanging passages between the tanks 111 and 112. These heat exchanging passages are also communicated with the tanks 111, 112. Similarly, the "upwind-side" heat exchanging part 120 has an upper tank 121, a lower tank 122 and a plurality of heat exchanging passages between the tanks 121 and 122. As well, these heat exchanging passages are communicated with the tanks 121, 122.

The "downwind-side" heat exchanging part 110 and the "upwind-side" heat exchanging part 120 are arranged so as to overlap each other back and forth in the flowing direction of wind.

In the downwind-side heat exchanging part 110, the upper tank 111 is provided, on its right side, with an evaporator inlet 107. The upper tank 111 is partitioned to a first upper tank part 111*a* and a second upper tank part 11*b* by a partition 114, while the lower tank 112 is partitioned to a first lower tank part 112*a* and a second lower tank part 112*b* by a partition 115. The laminated heat exchanging passages are divided into a first path 110*a*, a second path 110*b* and a third path 110*c* in order from the right. Consequently, coolant introduced into the downwind-side heat exchanging part 110 via the evaporator inlet 107 flows through the first upper tank part 111*a*, the first path 110*a*, the first lower tank part 112*a*, the second path 110*b*, the second upper tank part 111*b*, the third path 110*c* and the second lower tank part 112*b*, in this order. Then, the coolant is introduced from the most downstream side (i.e. the second lower tank part 112*b*) of the downwind-side heat exchanging part 110 into the most upstream side (i.e. the first lower tank part 122*a*) of the upwind-side heat exchanging part 120 through a communication passage 109.

In the upwind-side heat exchanging part 120, the lower tank 122 is partitioned to a first lower tank part 122*a* and a second lower tank part 122*b* by a partition 124, while the upper tank 121 is partitioned to a first upper tank part 121*a* and a second upper tank part 121*b* by a partition 125. The upper tank 121 is provided, on its right side, with an evaporator outlet 108. Thus, the laminated heat exchanging passages are divided into a first path 120*a*, a second path 120*b* and a third path 120*c* in order from the right. Consequently, the coolant introduced into the upwind-side heat exchanging part 120 via the communication passage 109 flows through the first lower tank part 122*a*, the first path 120*a*, the first upper tank part 121*a*, the second path 120*b*, the second lower tank part 122*b*, the third path 120*c* and the second upper tank part 121*b*, in this order. Then, the coolant is discharged from the evaporator 100 through the evaporator outlet 108 on the right side of the second upper tank part 121*b* as the most downstream part of the upwind-side heat exchanging part 120.

Here noted, the paths overlapping on the upwind and downwind sides, for example, the first path 110*a* of the downwind-side heat exchanging part 110 and the third path 120*c* of the upwind-side heat exchanging part 120 have the number of heat exchanging passages equal to each other and the flowing direction of coolant opposite to each other, including the flowing of coolant in the tank parts.

With the above-mentioned structure, the liquid-phase coolant L in the heat exchanging parts 110, 120 is distributed as shown in FIG. 2A. Consequently, the distribution of liquid-phase coolant L in the whole evaporator is shown in FIG. 2B. In FIG. 2B, since the wind cannot be cooled down sufficiently in areas where the liquid-phase coolant L does not flow, in other words, only gas-phase coolant G does flow, the "blowout" temperature of the coolant is elevated disadvantageously.

SUMMARY OF THE INVENTION

In the above-mentioned situation, it is an object of the present invention to provide an evaporator including upwind-side and downwind-side opposing paths each having the flowing directions of coolant opposite to each other, the evaporator enabling a reduction of an area causing a rise in "blowout" temperature of the liquid-phase coolant due to its short supply.

In order to attain the above object, an aspect of the present invention provides an evaporator comprising: heat exchanging parts juxtaposed on both upwind and downwind sides in a flowing direction of wind passing through the evaporator, the heat exchanging parts each including: a plurality of heat exchanging passages each formed to extend vertically and arranged so as to be laminated on each other along a horizontal direction of the evaporator, for performing heat exchange between a coolant flowing inside the heat exchanging passages and air flowing outside the heat exchanging passages; a plurality of tanks communicatively connected to respective upper and lower ends of the heat exchanging passages and each arranged so as to extend horizontally; and a plurality of partitions arranged in the tanks to divide the heat exchanging parts into a plurality of paths so that one of the heat exchanging parts has a meandering number of the heat exchanging passages equal to the meandering number of the heat exchanging passages in the other of the heat exchanging parts, the paths including upwind-side paths arranged on the upwind side in the flowing direction of wind and downwind-side paths arranged on the downwind side so as to each oppose to the upwind-side paths respectively, wherein a flowing direction of the coolant flowing in the upwind-side paths is opposite to a flowing direction of the coolant flowing in the downwind-side path opposing the upwind-side paths, and wherein the number of heat exchanging passages in the paths where the coolant rises is smaller than the number of heat exchanging passages in the paths where the coolant downs.

Since the number of heat exchanging passages in the paths where the coolant rises is smaller than the number of heat exchanging passages in the paths where the coolant downs, it becomes possible to increase the quantity of coolant flowing in the former paths that are apt to be short in supplying the coolant. As the result, it is possible to reduce an area causing a rise in "blowout" temperature of the coolant due to the short supply.

According to a preferred embodiment of the present invention, the coolant first flows in either one of the heat exchanging parts on the upwind and downwind sides in the flowing direction of wind and subsequently flows in the other of the heat exchanging parts.

Since the coolant flows in the heat exchanging parts in order, the coolant can be cooled down sufficiently.

The evaporator may further comprises a side plate attached to an outermost side of the heat exchanging passages in a laminating direction thereof to reinforce the evaporator, wherein the side plate has a communication passage integrally formed therein to communicate, in a flowing direction of the coolant, a most downstream part of the heat exchanging part on the upstream side in the flowing direction of the coolant with a most upstream part of the heat exchanging part on the downstream side in the flowing direction of the coolant.

Since the communication passage is formed integrally with the side plate, there is no need to prepare an exclusive member for the communication passage. As the result, it is possible to save the manufacturing cost of the evaporator.

These and other objects and features of the present invention will become more fully apparent from the following description and appended claims taken in conjunction with the accompanying drawings.

BRIEF DESCRIPTION OF THE DRAWINGS

FIG. 7A is a plan view of the side plate, FIG. 7B a view of the side plate viewed in the direction of arrow B of FIG. 7A, FIG. 7C a view of the side plate viewed in the direction of arrow C of FIG. 7A and FIG. 7D a view of the side plate viewed in the direction of arrow D of FIG. 7A;

FIGS. 8A to 8D are various views of another side plate of the evaporator of FIG. 3, on the right side in the width direction of the evaporator: FIG. 8A is a plan view of the side plate, FIG. 8B a view of the side plate viewed in the direction of arrow B of FIG. 8A, FIG. 8C a view of the side plate viewed in the direction of arrow C of FIG. 8A and FIG. 8D a view of the side plate viewed in the direction of arrow D of FIG. 8A;

FIG. 9A is a plan view of the first metal sheet, FIG. 9B a view of the first metal sheet viewed in the direction of arrow B of FIG. 9A, FIG. 9C a view of the first metal sheet viewed in the direction of arrow C of FIG. 9A and FIG. 9D a view of the first metal sheet viewed in the direction of arrow D of FIG. 9A;

FIG. 10A is a plan view of the second metal sheet, FIG. 10B a view of the second metal sheet viewed in the direction of arrow B of FIG. 10A, FIG. 10C a view of the second metal sheet viewed in the direction of arrow C of FIG. 10A and FIG. 10D a view of the second metal sheet viewed in the direction of arrow D of FIG. 10A;

DETAILED DESCRIPTION OF THE PREFERRED EMBODIMENT

Referring to the accompanying drawings, an embodiment of the present invention will be described below.

FIGS. 3 to 15B show an embodiment of the present invention. An evaporator 1 of this embodiment can be used for an evaporator that is interposed in a refrigeration cycle of an automotive air conditioner. The evaporator 1 is positioned in an air-conditioner casing inside an instrument panel of a vehicle. The evaporator 1 carries out heat exchanging between coolant flowing in the air-conditioner casing and air passing through the outside of the air-conditioner casing. In the evaporator 1, the coolant is evaporated to cool down the air.

Figure 14:
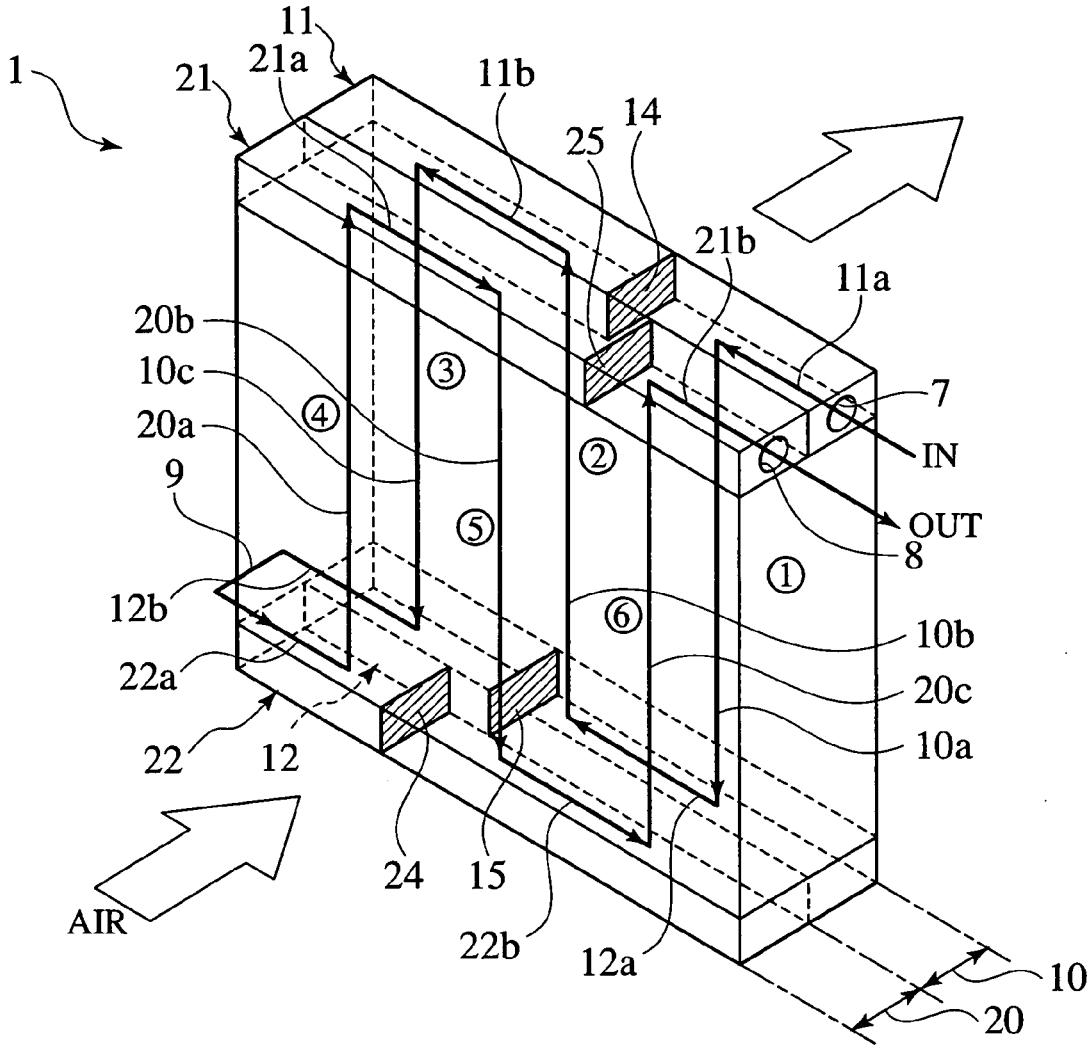
FIG. 14 is a schematic view of the evaporation, showing the flowing of coolant therein.

First of all, the whole structure of the evaporator 1 will be described with reference to FIG. 14, in brief.

The evaporator 1 includes two heat exchanging parts 10, 20 juxtaposed on upwind and downwind sides, respectively.

The "downwind-side" heat exchanging part 10 has an upper tank 11, a lower tank 12 and a plurality of heat exchanging passages between the upper tank 11 and the lower tank 12. These heat exchanging passages are also communicated with the tanks 11, 12. Similarly, the "upwind-side" heat exchanging part 20 has an upper tank 21, a lower tank 22 and a plurality of heat exchanging passages between the upper tank 21 and the lower tank 22. As well, these heat exchanging passages are communicated with the tanks 21, 22.

In the downwind-side heat exchanging part 10, the upper tank 11 is partitioned to a first upper tank part 11*a* and a second upper tank part 11*b* by a partition 14, while the lower tank 12 is partitioned to a first lower tank part 12*a* and a second lower tank part 12*b* by a partition 15. The upper tank 11 is provided, on its right side, with an evaporator inlet 7. The heat exchanging passages stacked in multistage are divided into a first path 10*a*, a second path 10*b* and a third path 10*c* in order from the right. Consequently, the coolant introduced into the downwind-side heat exchanging part 10 via the evaporator inlet 7 flows through the first upper tank part 11*a*, the first path 10*a*, the first lower tank part 12*a*, the second path 10*b*, the second upper tank part 11*b*, the third path 10*c* and the second lower tank part 12*b*, in this order. Then, the coolant is introduced from the most downstream side (i.e. the second lower tank part 12*b*) of the downwind-side heat exchanging part 10 into the most upstream side (i.e.

the first lower tank part 22*a*) of the upwind-side heat exchanging part 20 through a communication passage 9.

In the upwind-side heat exchanging part 20, the lower tank 22 is partitioned to a first lower tank part 22*a* and a second lower tank part 22*b* by a partition 24, while the upper tank 21 is partitioned to a first upper tank part 21*a* and a second upper tank part 21*b* by a partition 25. The upper tank 21 is provided, on its right side, with an evaporator outlet 8. The heat exchanging passages stacked in multistage are divided into a first path 20*a*, a second path 20*b* and a third path 20*c* in order from the right. Consequently, the coolant introduced into the upwind-side heat exchanging part 20 via the communication passage 9 flows through the first lower tank part 22*a*, the first path 20*a*, the first upper tank part 21*a*, the second path 20*b*, the second lower tank part 22*b*, the third path 20*c* and the second upper tank part 21*b*, in this order. Then, the coolant is discharged from the evaporator 1 through the evaporator outlet 8 on the right side of the second upper tank part 21*b* as the most downstream part of the upwind-side heat exchanging part 20 on the outlet-side of the coolant's flow.

In the evaporator 1, the heat exchanging parts 10, 20 are each divided into the plural paths (e.g. three paths each in the shown example, that is, the paths 10*a*, 10*b*, 10*c* and the paths 20*a*, 20*b*, 20*c*) so as to have the same meandering number in each of the parts 10, 20. Further, in the opposing paths overlapped on both "upwind" and "downwind" sides (for example, the first path 10*a* of the part 10 and the third path 20*c* of the part 20), the flowing directions of the coolant therein are opposite to each other, vertically and horizontally, including the coolant's flows in the tank parts on the upstream and downstream sides of the opposing paths.

As shown in FIGS. 3 to 6, the evaporator 1 of this embodiment includes a plurality of tubes 30 stacked on each other and a plurality of outer fins 33 each interposed between the adjoining tubes 30. Each of the tubes 30 includes a pair of metal sheets 40 (40A, 40B). The tube 30 is produced by laying the reversed metal sheet 40A on the metal sheet 40B and further welding them to each other. In order to reinforce the strength of the evaporator 1, side plates 34, 35 are arranged on both "outermost" sides of the evaporator 1 in the laminating direction of the tubes 30, providing it with a designated configuration.

As shown in FIGS. 5, 8A, 8B, 8C and 8D, the side plate 34 has a communication port 34*a* formed in communication with the most upstream part (the first upper tank part 11*a*) of the heat exchanging part 10 and another communication port 34*b* formed in communication with the most downstream part (the second upper tank part 21*a*) of the heat exchanging part 20. A piping connector 36 forming the inlet 7 and the outlet 8 of the evaporator 1 is attached to the communication ports 34*a*, 34*b*. The other side plate 35 (see FIGS. 6, 7A, 7B, 7C and 7D) has a communication passage 9 formed to communicate the most downstream part of the part 10 (i.e. the second lower tank part 12*b*) with the most upstream part of the part 20 (i.e. the first lower tank part 22*a*). Noted that reference numerals 35*b* denote reinforcing protrusions formed on the side plate 35, while reference numeral 37 denotes a reinforcing plate arranged between the side plate 34 and the piping connector 36.

The constitution of the tube 30 will be described below.

Figure 11A:
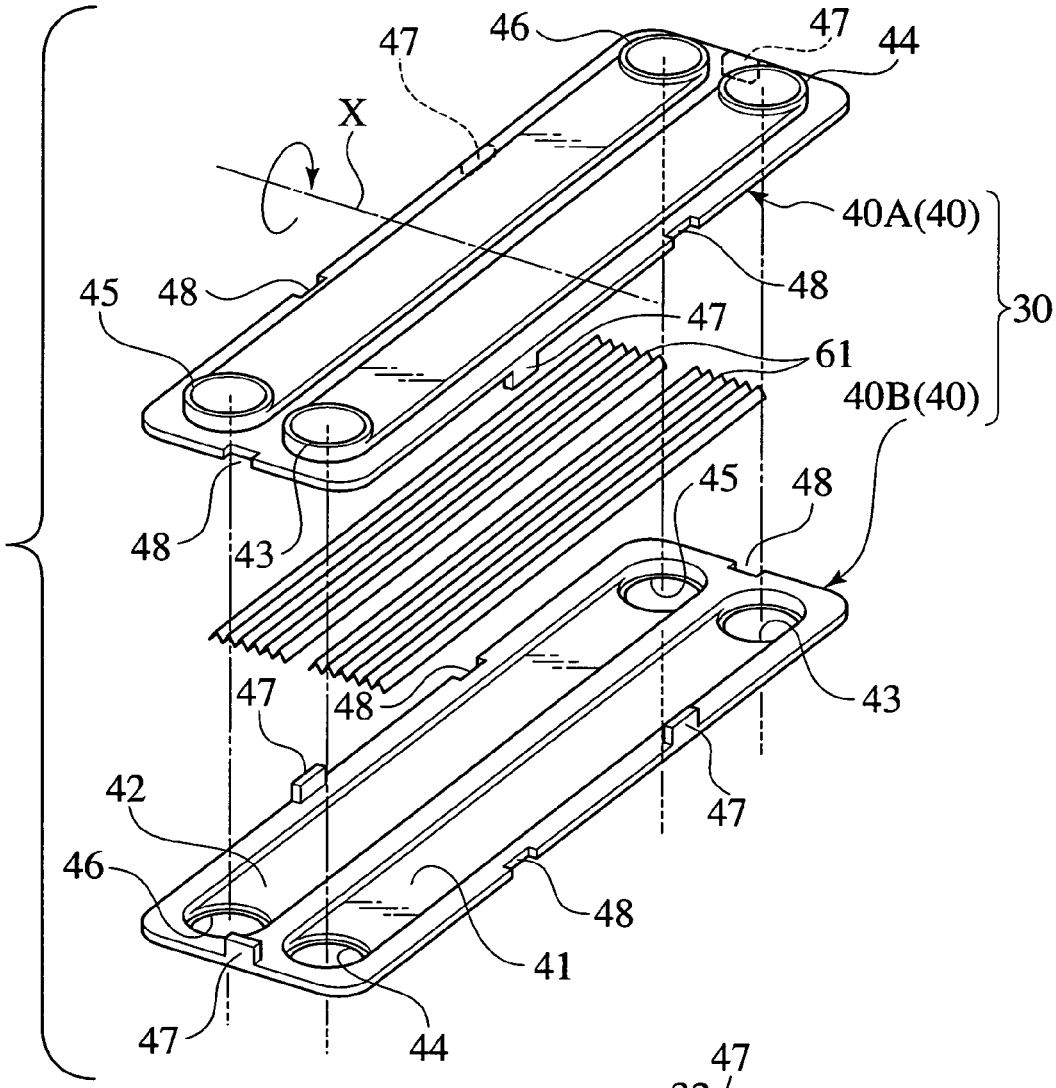
FIG. 11A is an exploded perspective view of the tube, showing its lamination structure
Figure 11B:
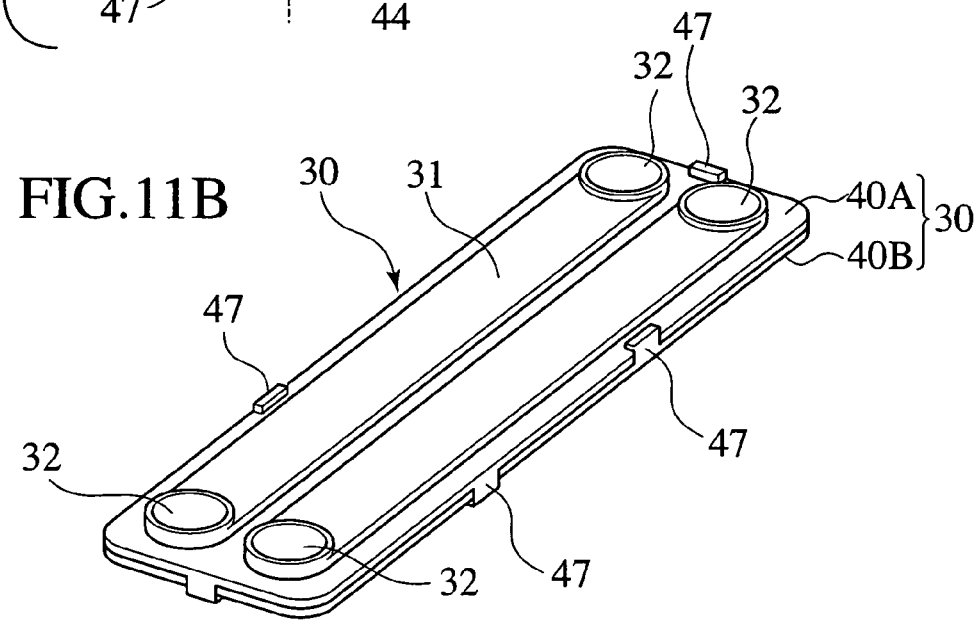
FIG. 11B is a perspective view of the tube in its assembled state.

FIG. 11A is a perspective view of the tube 30, showing its exploded state. FIG. 11B is a perspective view of the tube 30 in its assembled state. FIGS. 9A to 9D show the metal sheet 40 (40A or 40B) forming the tube 30. Noted that the metal sheet 40A has a configuration identical to that of the metal sheet 40B. As shown in FIG. 11A, the posture of the metal sheet 40B can be obtained by turning over the metal sheet 40A about a center axis X for inversion, and vice versa.

The tube 30 is provided, therein, with heat exchanging passages 31, 31 for heat exchange between the coolant flowing in the passages 31, 31 and air flowing outside the tube 30. The heat exchanging passages 31, 31 comprise one heat exchanging passage 31 for the "downwind-side" heat exchanging part and another heat exchanging passage 31 for the "upwind-side" heat exchanging part. On both ends of the heat exchanging passage 31 in the longitudinal direction of the tube 30, cylindrical tank parts 32, 32 are formed so as to project upwardly. That is, each metal sheet 40A (40B) forming the tube 30 includes two concave "heat-exchanging passage" parts 41, 42 extending along the longitudinal direction of the tube 30 and four tank parts 43, 44, 45, 46 (32, 32).

The metal sheet 40 (40A or 40B) has a plurality of projecting pieces 47 and recesses 48 formed in the outer periphery of the sheet 40. Each of the projecting pieces 47 is positioned in line-symmetry with the notch 48 about the above axis X. Consequently, when opposing the interior side of the metal sheet 40A to the interior side of the metal sheet 40B, the projecting pieces 47 and the recesses 48 of the former sheet 40A oppose the recesses 48 and the projecting pieces 47 of the latter sheet 40B, respectively. Then, when confronting the former sheet 40A against the latter sheet 40B while maintaining the above postures of the sheets 40A, 40B, the projecting pieces 47 are engaged in the recesses 48 respectively, thereby effecting the mutual positioning of the sheets 40A, 40B.

Figure 12A:
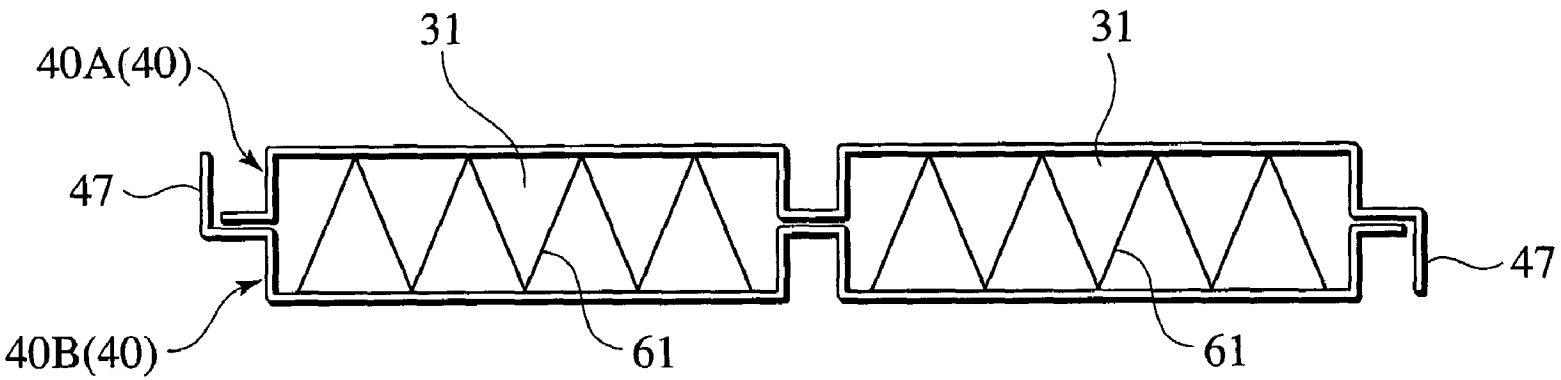
FIG. 12A is a sectional view of one pair of metal sheets before being caulked and FIG. 12B is a sectional view of the metal sheets after being caulked.
Figure 12B:
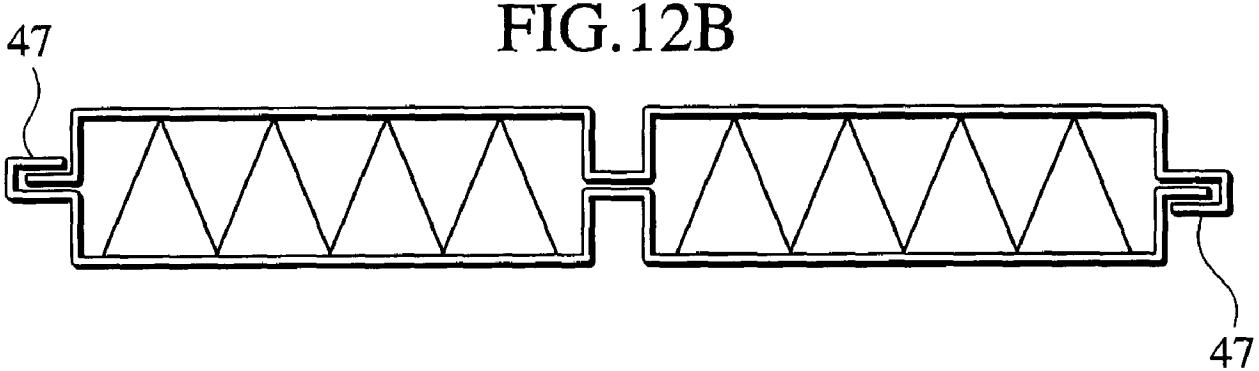
Figure 13:
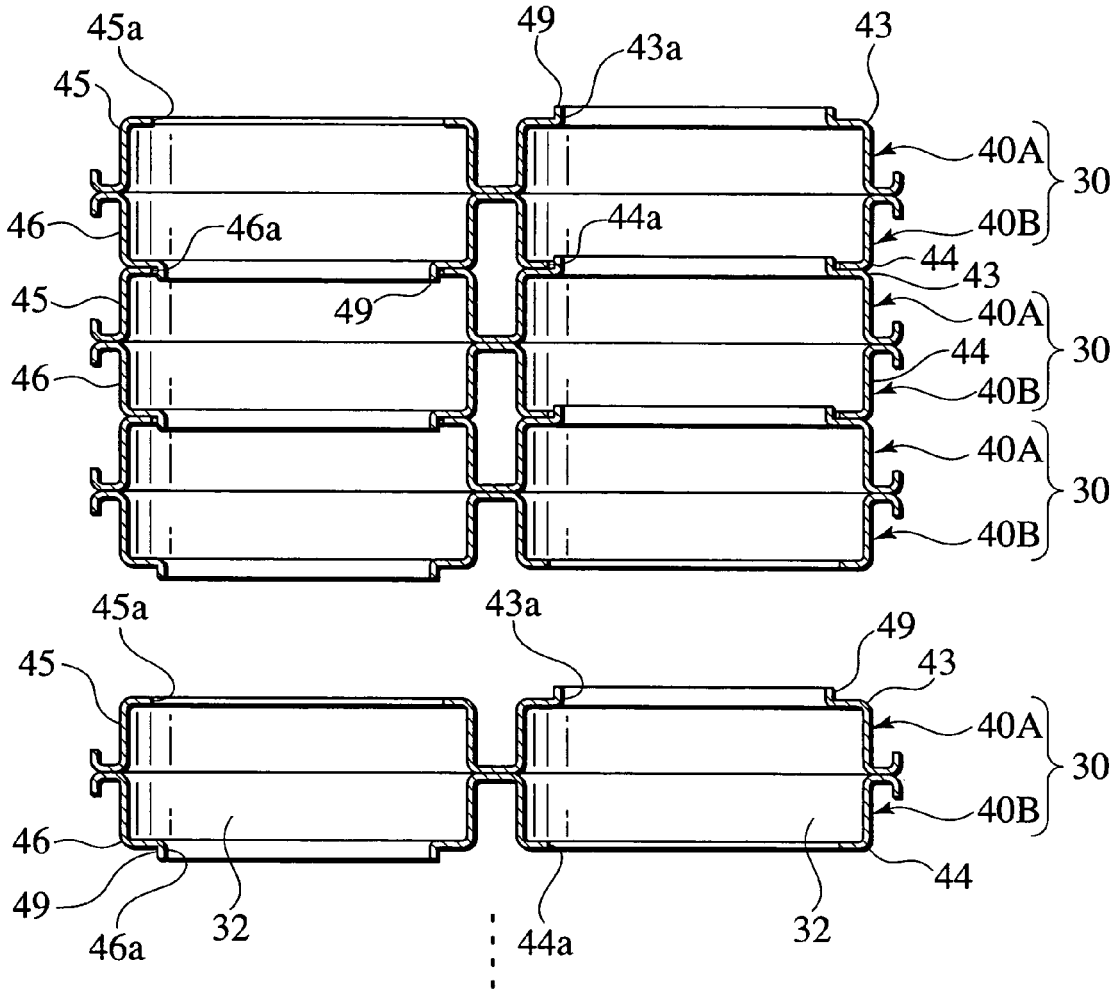
FIG. 13 is a sectional view of a tank part of the tubes, showing its lamination structure.

Noted that two inner fins 61, 61 are disposed between the metal sheet 40A and the metal sheet 40B before the engagement of projecting pieces 47 with the recesses 48. Then, as shown in FIGS. 12A and 12B, the metal sheets 40A, 40B are caulked by folding the projecting pieces 47 inwardly, realizing the tube 30 in a temporary fixed condition.

It is noted in the shown embodiment that the above top-and-back inversion axis X is identical to a sheet's center line extending along the direction perpendicular to the longitudinal direction of the metal sheet 40, namely, a center line for dividing the metal sheet 40 into two equal parts in the longitudinal direction of the sheet 40.

In the manufacturing procedure of the evaporator 1 (see FIGS. 11A and 11B), a plurality of tubes 30 in the above temporary fixed condition are laminated on each other, so that the evaporator shown in FIGS. 3 to 6 is assembled temporarily. Thereafter, by a not-shown jig, this assembly is transferred to a welding furnace. In connection, it is noted that FIGS. 11A and 11B do not illustrate the outer fin 33 for convenience of understanding.

According to the above-mentioned manufacturing process, the possibility of positioning the adjoining tubes 30 would allow the laminating operation of the tubes 30 to be automatized, whereby the manufacturing cost can be saved. In other words, the possibility of positioning the metal sheets 40A, 40B in their back-to-back condition would allow the laminating operation of the tubes 30 to be automatized to reduce the manufacturing cost of the evaporator 1. In order to offer such advantages in the evaporator 1, either one of the tank parts 43, 44 (45, 46) on both sides of one concave part 41 is provided with locating parts (locating means). In the embodiment shown in FIGS. 9A and 9B, the tank part 43 has an engagement projection 49 formed on the periphery of its opening end 43*a*, as the locating means. The tank part 46 has another engagement projection 49 formed on the periphery of its opening end 46*a* as well.

In assembling, the engagement projections 49 of the tank parts 43, 46 of one tube 30 are engaged in the opening ends 44*a*, 45*a* of the tank parts 44, 45 of the other tube 30. The engagements allow the adjoining tubes 30 in lamination to be positioned to each other.

In addition to the metal sheets 40, the evaporator 1 further includes a plurality of second metal sheets 50 each shown in FIGS. 10A to 10D. The second metal sheet 50 differs from the first metal sheet 40 in that an partition 51 is formed at one of the four tank parts 43, 44, 45 and 46. This integral-molding partition 51 constitutes each of the afore-mentioned partitions 14, 15, 24, 25 (see FIG. 14) for dividing the heat exchanging parts 10, 20 into the paths 10*a*, 10*b*, 10*c*, 20*a*, 20*b* and 20*c*. Depending on the position of the second metal sheet 50 that is interposed in the lamination of the tubes 30, the compartmentalization of these paths 10*a*, 10*b*, 10*c*, 20*a*, 20*b* and 20*c* is determined in the heat exchanging parts 10, 20. Note, in FIGS. 3 and 4, reference numerals 50A, 50B, 50C, 50D denote the same metal sheets 50 although some of them are inverted inside and out in the arrangement of the heat exchanger.

Figure 1:
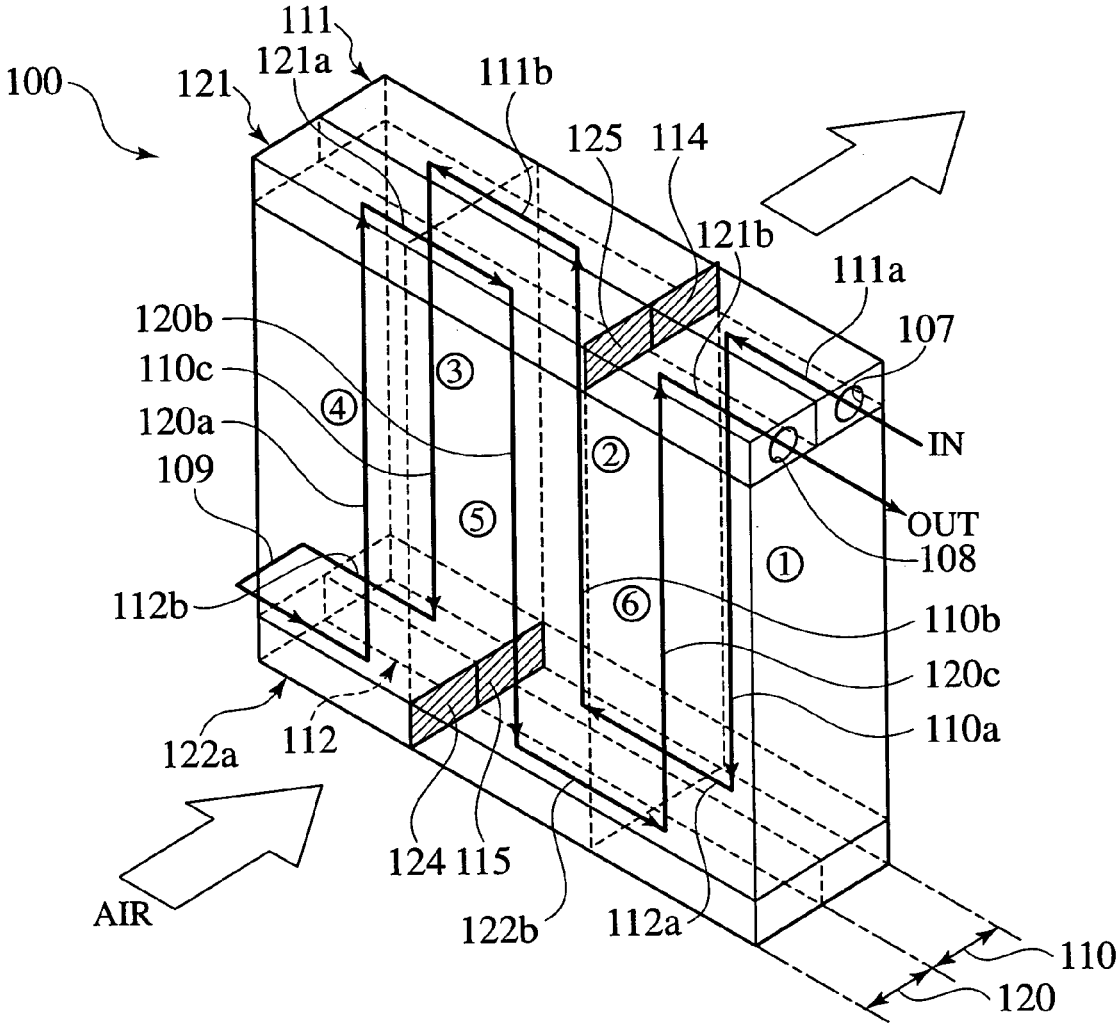
FIG. 1 is a schematic view showing an example of an evaporator.
Figure 2A:
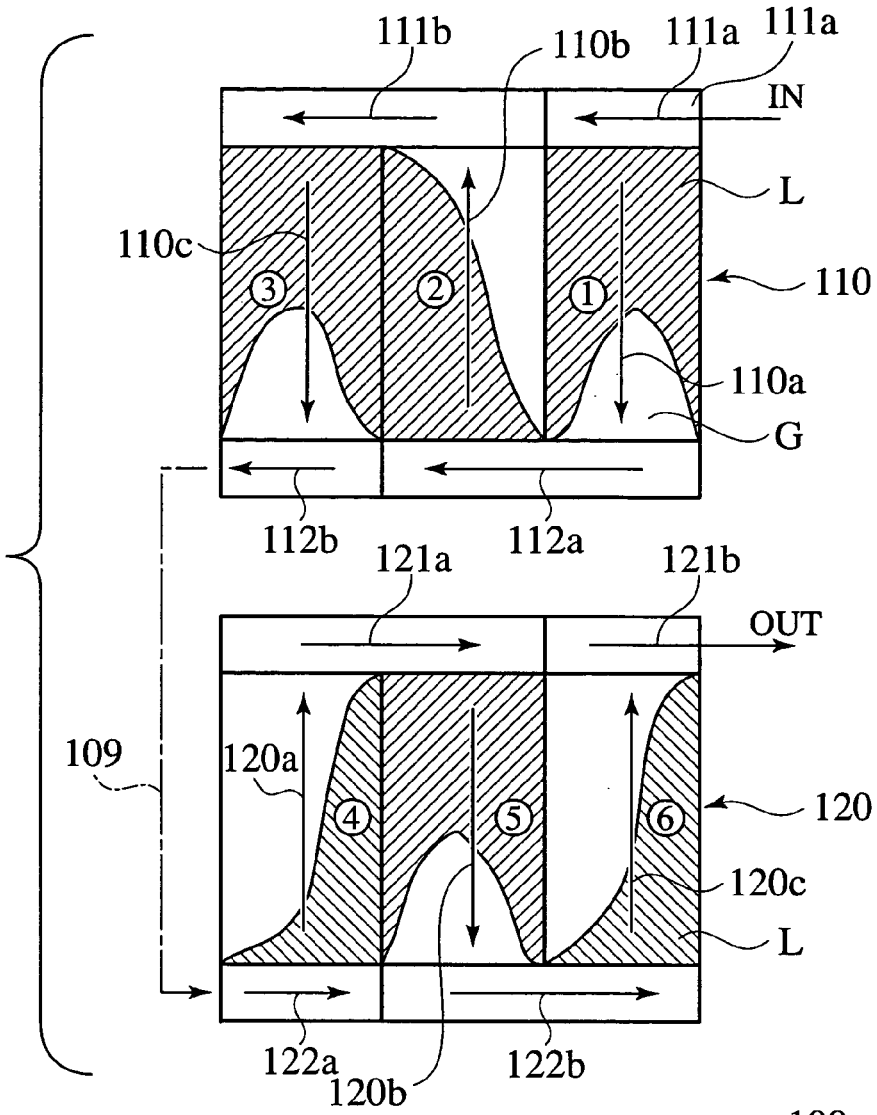
FIGS. 2A and 2B are schematic views showing the distribution of liquid-phase coolant in the evaporator of FIG. 1.
Figure 2B:
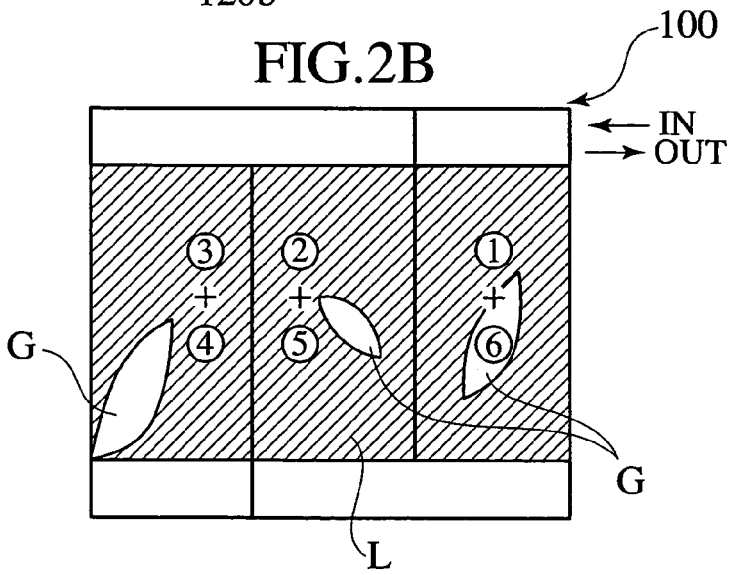
Figure 3:
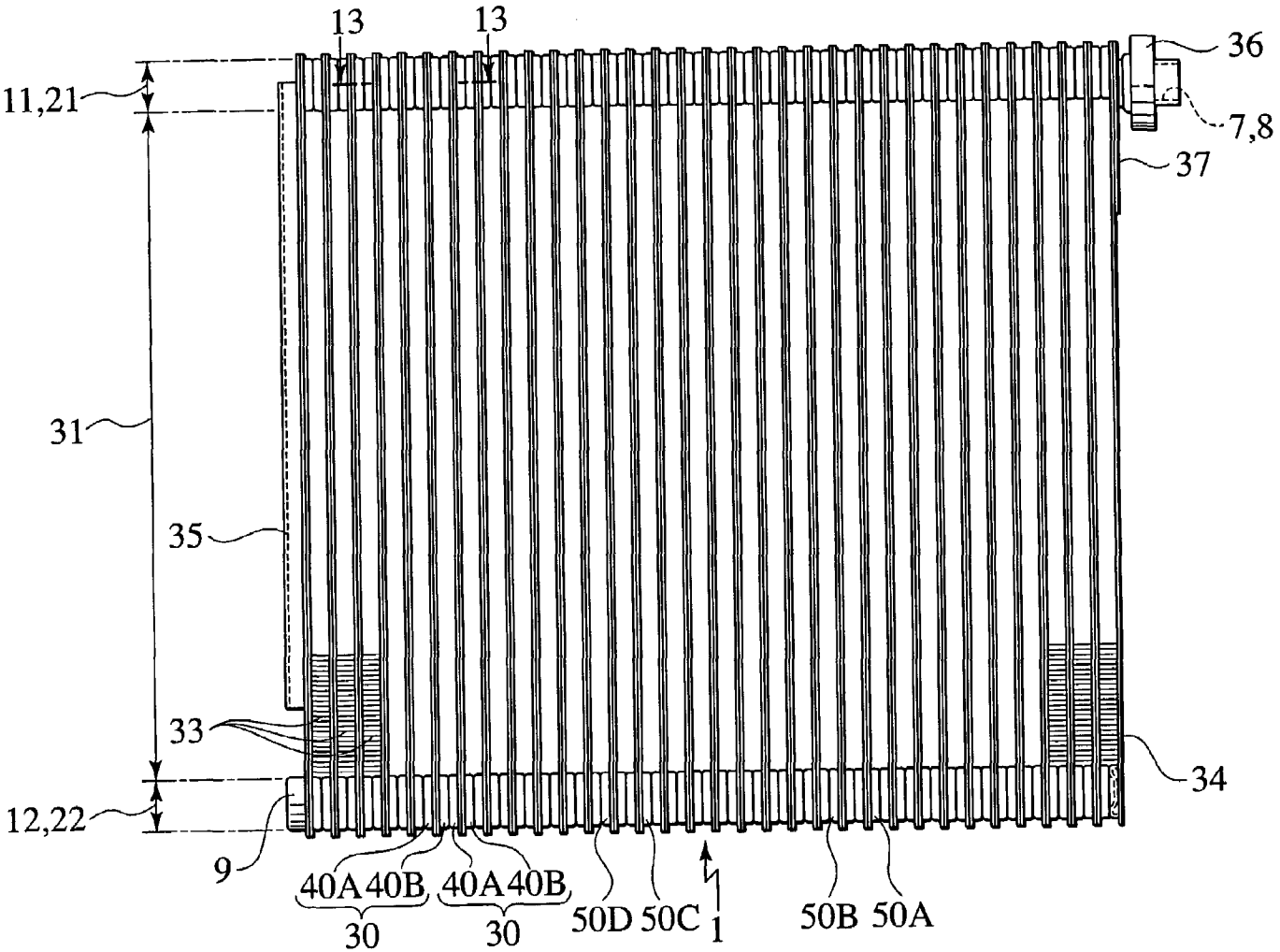
FIG. 3 is a front view of an evaporator in accordance with an embodiment of the present invention, also viewed from its upwind side.
Figure 4:
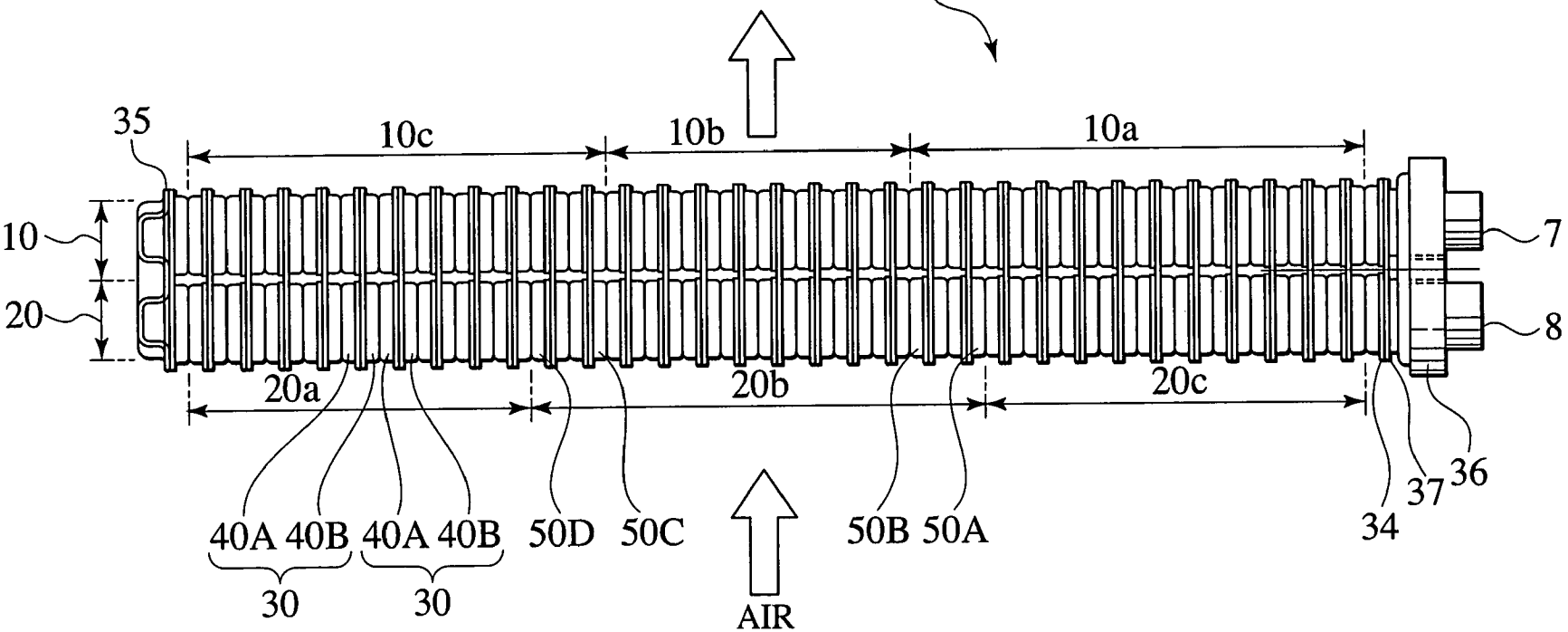
FIG. 4 is a top view of the evaporator of FIG. 3
Figure 5:
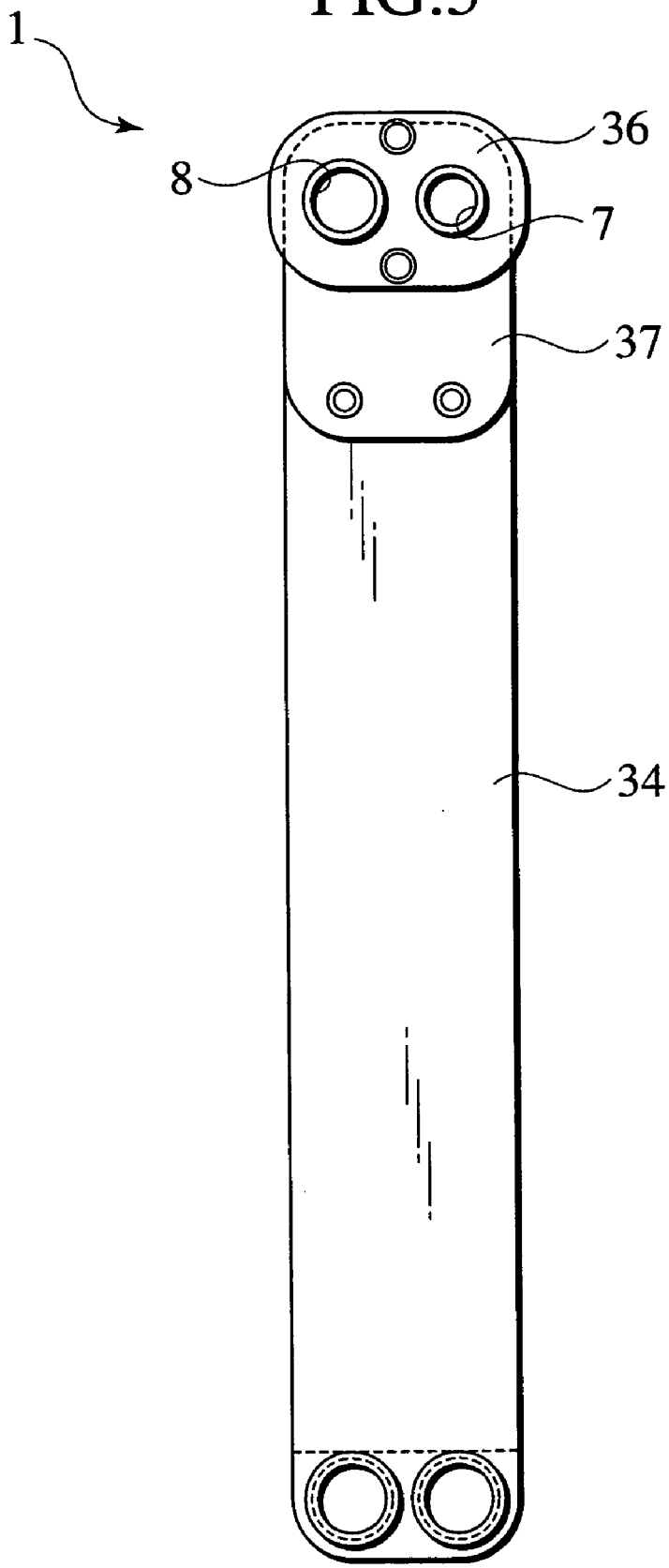
FIG. 5 is a side view of the evaporator of FIG. 3, on the right side in the width direction of the evaporator.
Figure 6:
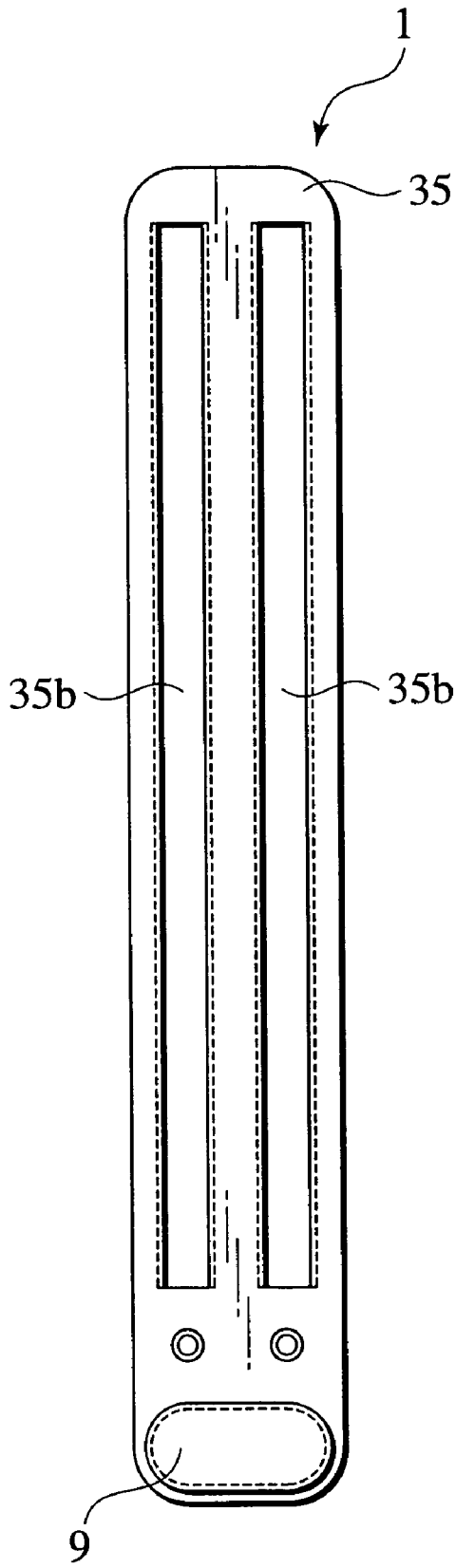
FIG. 6 is a side view of the evaporator of FIG. 3, on the left side in the width direction of the evaporator.
Figure 7C:
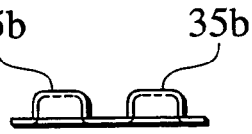
FIGS. 7A to 7D are various views of a side plate of the evaporator of FIG. 3, on the left side in the width direction of the evaporator.
Figure 7B:
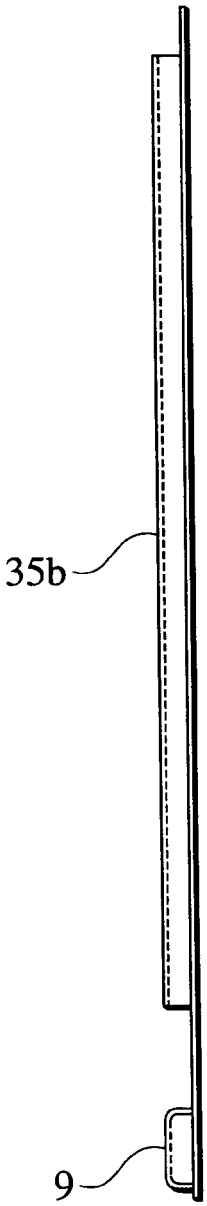
Figure 7A:
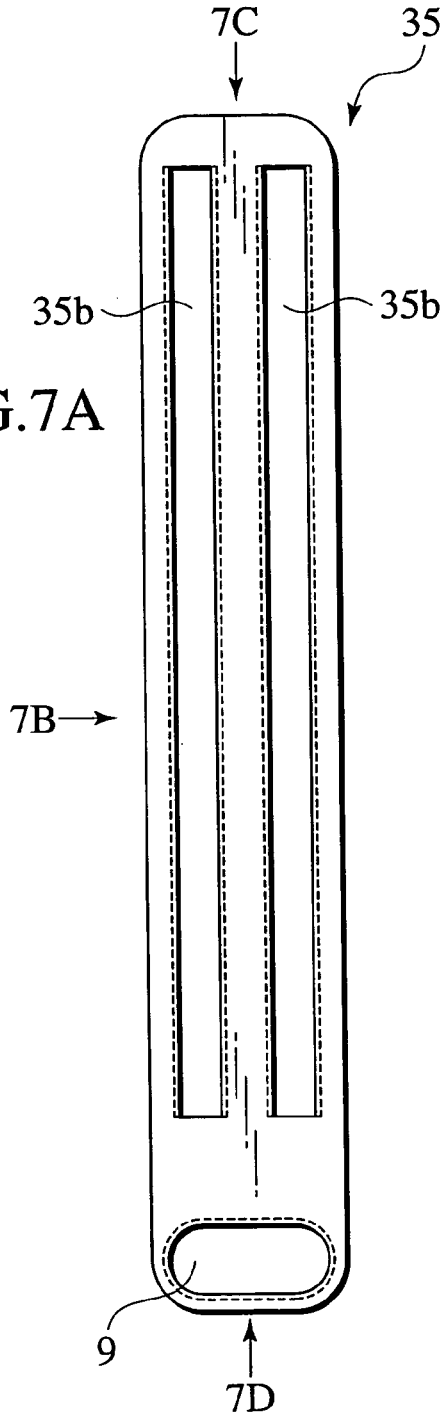
Figure 7D:
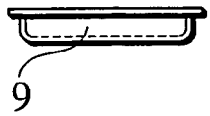
Figure 9C:
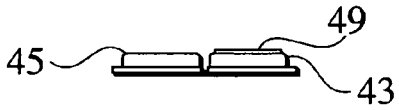
FIGS. 9A to 9D are various views of a first metal sheet forming a tube of the evaporator of FIG. 3.
Figure 9A:
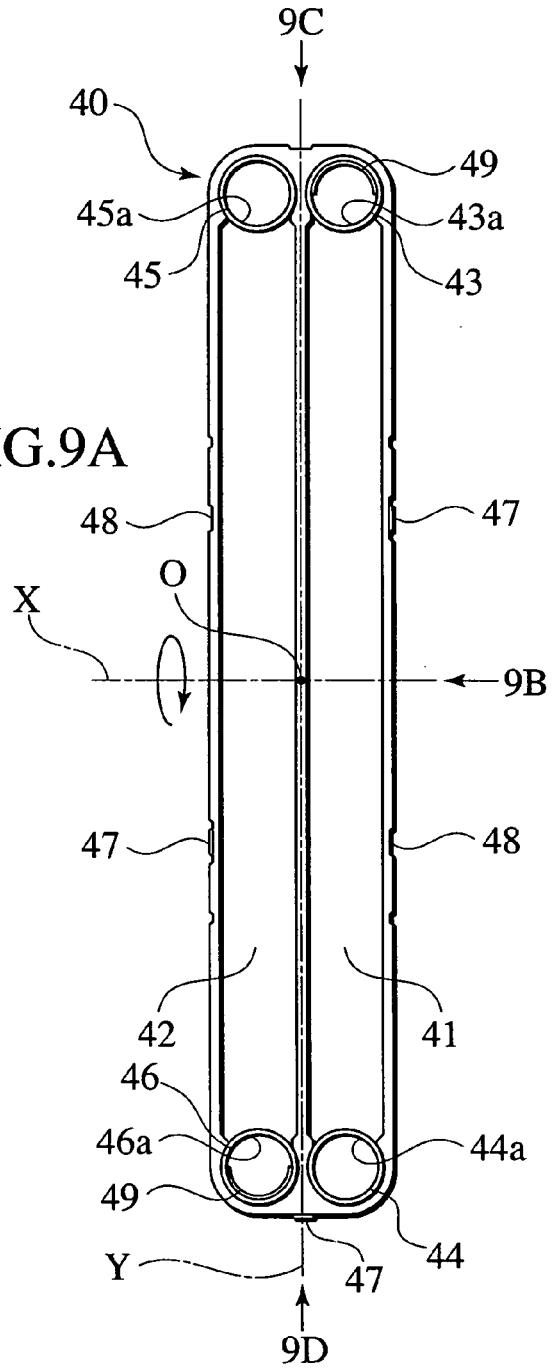
Figure 9B:
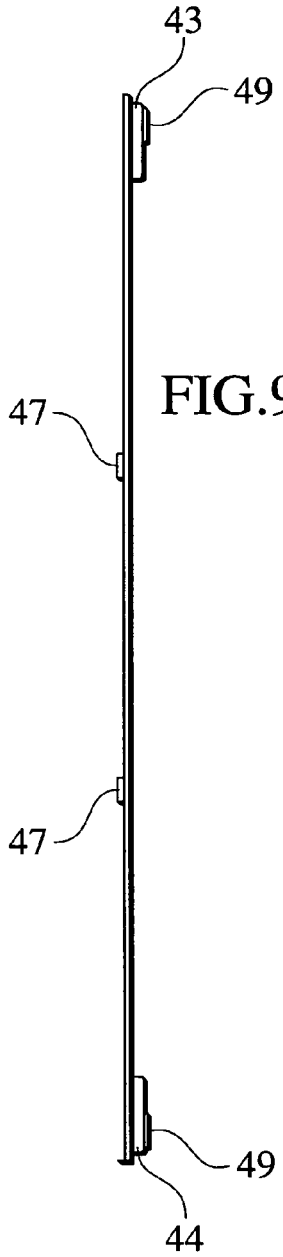
Figure 9D:
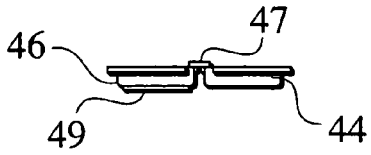
Figure 10C:
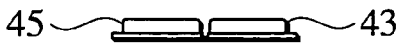
FIGS. 10A to 10D are various views of a second metal sheet forming a tube of the evaporator of FIG. 3.
Figure 10A:
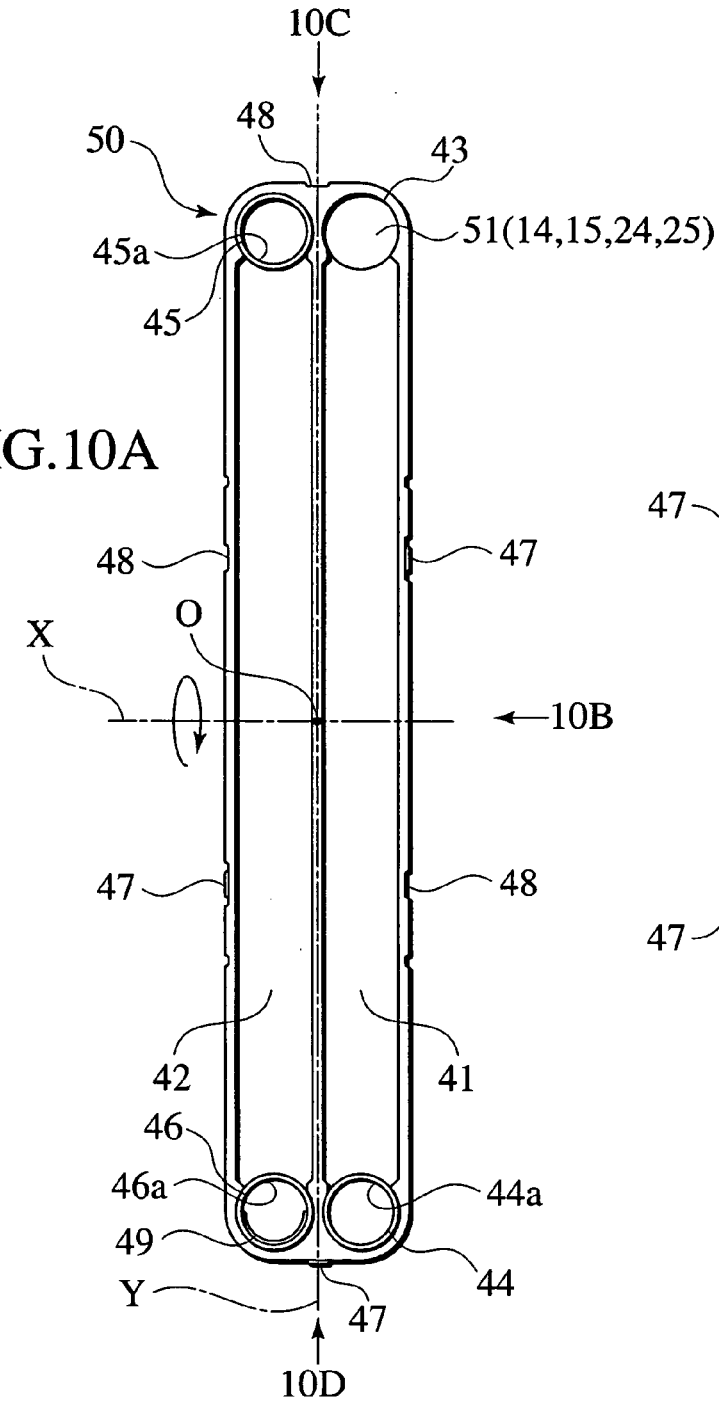
Figure 10B:
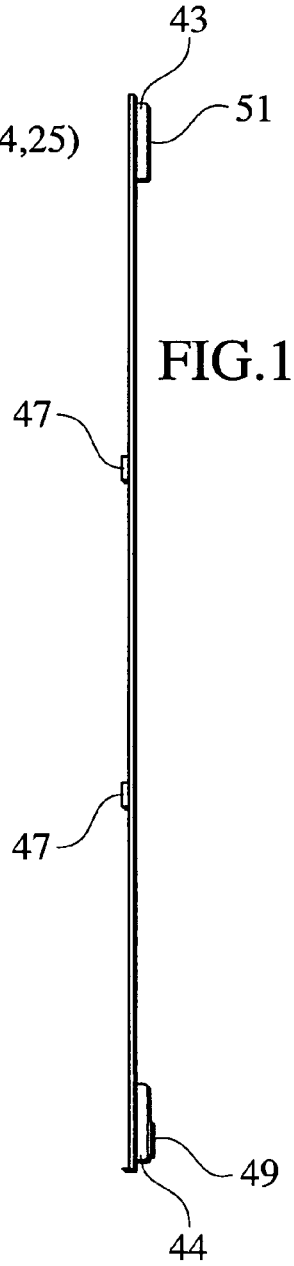
Figure 10D:
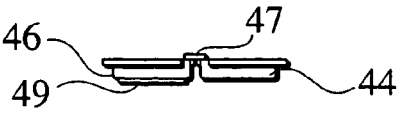
Figure 15A:
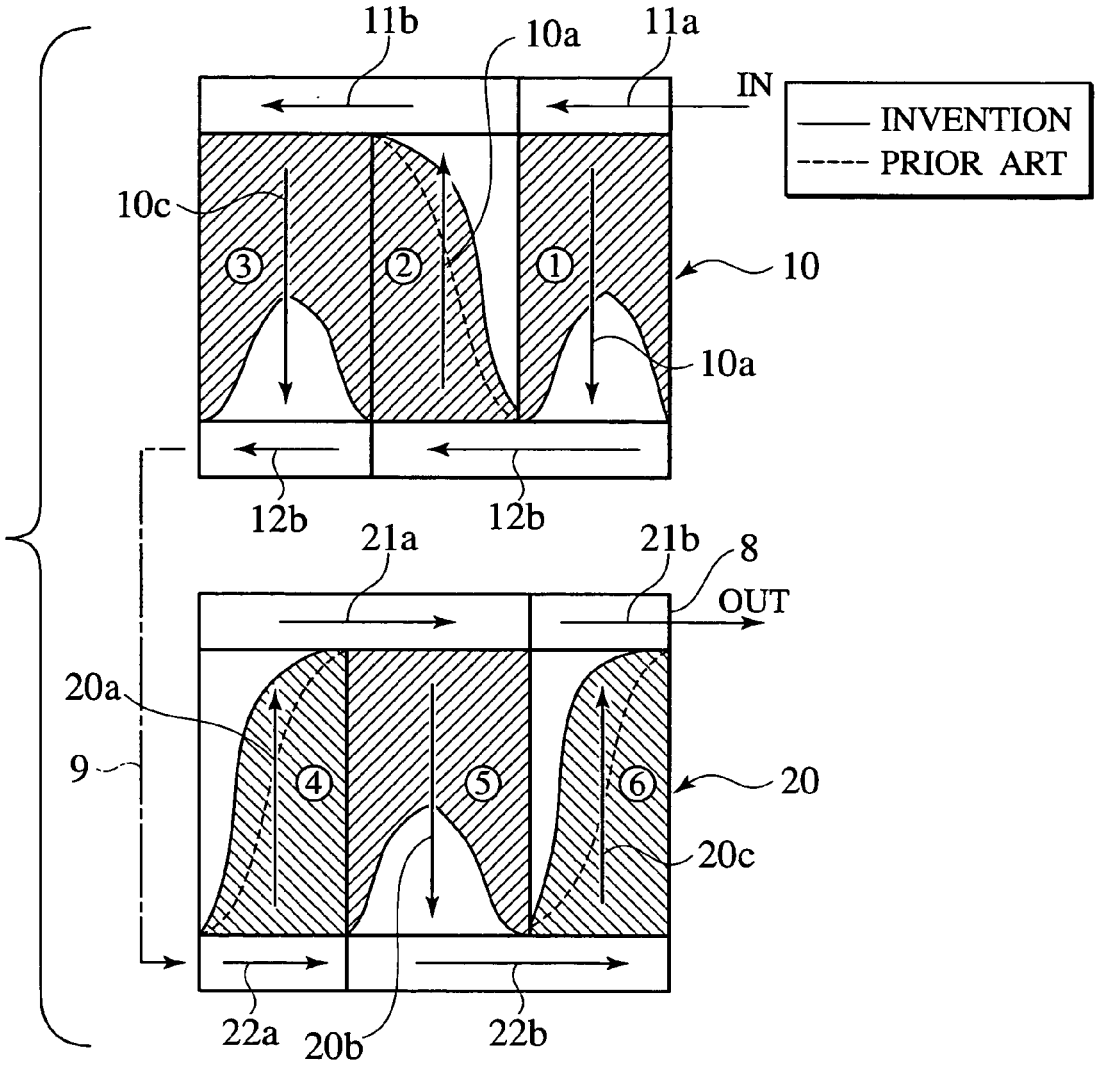
FIG. 15A is a schematic view showing the distribution of liquid-phase coolant in two evaporator parts.

The feature of the embodiment of the present invention resides in the compartmentalization of these paths due to the arrangement of the second metal sheets 50. As shown in FIGS. 4, 14, 15, the partition 25 is arranged on right side of the partition 14, and the partition 24 is arranged on left side of the partition 15. As shown in these figures, it is established that the number of heat exchanging passages in the paths 10*b*, 20*a* and 20*c* where the coolant rises is smaller than the number of heat exchanging passages in the paths 10*a*, 10*c* and 20*b* where the coolant downs. As the result, the dimensions of the paths 10*b*, 20*a* and 20*c* along the horizontal direction of the evaporator 1 become smaller than those of the paths 10*a*, 10*c* and 20*b*, respectively. In other words, the whole cross sectional area of the paths 10*b*, 20*a* and 20*c* becomes smaller than that of the paths 10*a*, 10*c* and 20*b*. Consequently, the pressure of the liquid-phase coolant rising in the paths 10*b*, 20*a* and 20*c* is higher than that in the conventional art.

Figure 15B:
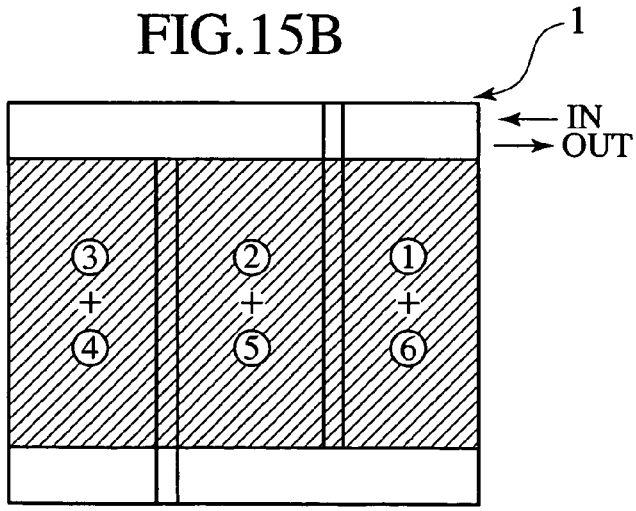
FIG. 15B is a schematic view showing the distribution of liquid-phase coolant in the evaporator parts in combination.

With the above establishment, the evaporator 1 of this embodiment enables an increasing of the quantity of liquid-phase coolant flowing in the upper side in paths 10*b*, 20*a* and 20*c* where the liquid-phase coolant used to be short conventionally. In other words, the liquid phase coolant rising in the paths 10*b*, 20*a* and 20*c* can rise higher than that in the conventional art. In the evaporator 1 where the upwind-side heat exchanging part 20 is superimposed on the downwind-side heat exchanging part 10 in the flowing direction of wind, consequently, it is possible to reduce an area causing a rise in "blowout" temperature of the liquid-phase coolant due to its short supply, as shown in FIG. 15B.

In the evaporator 1 of the embodiment, additionally, since the communication passage 9 that communicates the most downstream-side part 12*b* (in the flowing of coolant) of the downwind-side heat exchanging part 10 with the most upstream-side part 22*a* (in the flowing of coolant) of the upwind-side heat exchanging part 20 is formed in one body with the side plate 35 for reinforcing the evaporator 1, there is no need to prepare any exclusive member for the communication passage, whereby the manufacturing cost can be saved.

In summary, since it is established that the number of heat exchanging passages in the paths each where the coolant downs is smaller than the number of heat exchanging passages in the paths each where the coolant rises, it becomes possible to increase the quantity of coolant flowing in the former paths that are apt to be short in supplying the coolant. Consequently, it is possible to reduce an area causing a rise in "blowout" temperature of the coolant due to the short supply.

Finally, it will be understood by those skilled in the art that the foregoing descriptions are nothing but one embodiment of the disclosed evaporator and therefore, various changes and modifications may be made within the scope of claims.

What is claimed is:

1. An evaporator comprising:

heat exchanging parts juxtaposed on both upwind and downwind sides in a flowing direction of wind passing through the evaporator, the heat exchanging parts each including:

a plurality of heat exchanging passages each formed to extend vertically and arranged so as to be laminated on each other along a horizontal direction of the evaporator, for performing heat exchange between a coolant flowing inside the heat exchanging passages and air flowing outside the heat exchanging passages;

a plurality of tanks communicatively connected to respective upper and lower ends of the heat exchanging passages and each arranged so as to extend horizontally; and a plurality of partitions arranged in the tanks to divide the heat exchanging parts into a plurality of paths so that one of the heat exchanging parts has a meandering number of the heat exchanging passages equal to the meandering number of the heat exchanging passages in the other of the heat exchanging parts, the paths including upwind-side paths arranged on the upwind side in the flowing direction of wind and downwind-side paths arranged on the downwind side so as to each oppose the upwind-side paths respectively, wherein a flowing direction of the coolant flowing in the upwind-side paths is opposite to a flowing direction of the coolant flowing in the downwind-side path opposing to the upwind-side paths, and wherein the number of heat exchanging passages in the paths where the coolant rises is smaller than the number of heat exchanging passages in the paths where the coolant flows downward.

2. An evaporator of claim 1, wherein the coolant first flows in either one of the heat exchanging parts on the upwind and downwind sides in the flowing direction of wind and subsequently flows in the other of the heat exchanging parts.

3. An evaporator of claim 2, further comprising a side plate attached to an outermost side of the heat exchanging passages in a laminating direction thereof to reinforce the heat exchanging part, wherein the side plate has a communication passage integrally formed therein to communicate, in a flowing direction of the coolant, a most downstream part of the heat exchanging part on the upstream side in the flowing direction of the coolant with a most upstream part of the heat exchanging part on the downstream side in the flowing direction of the coolant.

* * * * *

UNITED STATES PATENT AND TRADEMARK OFFICE

CERTIFICATE OF CORRECTION

PATENT NO. : 7,219,511 B2
APPLICATION NO. : 10/919742
DATED : May 22, 2007
INVENTOR(S) : Hiroyuki Inaba et al.

It is certified that error appears in the above-identified patent and that said Letters Patent is hereby corrected as shown below:

Title Page

Under Assignee (73):

Please replace “Kansai” with --Kansei--

Signed and Sealed this

Twenty-third Day of October, 2007

JON W. DUDAS
*Director of the United States Patent and Trademark Office*